US006386283B1

(12) United States Patent
Mosing et al.

(10) Patent No.: US 6,386,283 B1
(45) Date of Patent: May 14, 2002

(54) ELEVATOR AND SPIDER CONVERTER

(75) Inventors: Donald E. Mosing, Lafayette; David L. Sipos, Youngsville, both of LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/842,286

(22) Filed: Apr. 25, 2001

(51) Int. Cl.[7] ..... E21B 19/06; E21B 19/10; E21B 3/04

(52) U.S. Cl. ..... 166/75.14; 166/78.1; 464/163; 294/102.2

(58) Field of Search ..... 166/78.1, 75.14, 166/77.51; 188/67; 175/195, 423; 464/163; 285/123.3; 294/102.2

(56) References Cited

U.S. PATENT DOCUMENTS 1,496,256 A * 6/1924 Davidson ..... 188/67
1,825,930 A * 10/1931 Zerbe ..... 188/67
5,036,927 A * 8/1991 Willis ..... 175/162
5,297,833 A * 3/1994 Willis et al. ..... 294/102.2
6,089,338 A 7/2000 Bouligny, Jr.
6,227,587 B1 * 5/2001 Terral ..... 294/102.2
6,237,684 B1 * 5/2001 Bouligny, Jr. et al. ... 166/77.52

* cited by examiner

*Primary Examiner*—David Bagnell
*Assistant Examiner*—David P Stephenson
(74) *Attorney, Agent, or Firm*—John D. Jeter

(57) ABSTRACT

Shaped plates are provided, one above each side of a spider, to replace the bails and links used to suspend the spider and its pipe payloads. The load applied to the housing suspension hard points, whether ears or lugs, to suspend the spider is transferred to the rig floor by the plates. The plates are preferably shaped to balance about a cross pin situated in a cross bore in the plates. The plates are not inclined to tilt whether being hoisted or loaded by the spider. The spider is submerged into the rotary opening and results in reduced height of pipe string connections to be worked.

20 Claims, 3 Drawing Sheets

ELEVATOR AND SPIDER CONVERTER

This invention pertains to apparatus to support a drilling rig elevator, or spider, in the opening of a rotary table. Essentially, it makes a flush spider of a conventional elevator or spider.

BACKGROUND OF THE INVENTION

On drilling rigs, the traveling block is usually equipped with bails that hang from ears on each side to suspend loads. The bails, in turn have eyes or loops at the lower end to engage ears or lugs, on pipe elevators that engage the top end of pipe strings to suspend them in wells. Elevators and spiders both grip pipe in much the same manner and may have identical pipe engaging contrivances. Spiders, however, usually remain on the rig floor and support pipe strings when the elevators are not raising or lowering the pipe string. Both elevators and spiders commonly have housing structure that can transfer the load of a suspended pipe string to lifting engagement means, on the housing, that transfer the load to a traveling block by way of bails or links. Lifting engagement means may be ears that engage bails, or lugs that engage links. Bails have loops and links have eyes to engage the lifting engagement means.

Elevators usually have a pipe guide funnel, or flange, on the bottom and that feature normally will not support a heavy pipe string load. If the flange fitted elevator is suspended in the rotary table by the structure of this invention the flange does not have to be removed to convert the elevator to a spider.

There is a need to reduce the height from the rig floor to the upper end of the pipe string where connections have to be worked. The joints are worked above the stack height of both elevator and spider. Suspending the spider into the rotary table opening can reduce the height of the connection above the rig floor.

If the opening in the rotary table is large enough to permit structure to suspend a floor plate in the opening, a spider can be installed in the opening to rest on the floor plate. That is a well-known practice. If the spider diameter is too near the diameter of the rotary table opening, there is no room for the suspension structure.

Spiders are known to have been used when supported on a movable plate that rested on the rig floor above the rotary table opening. That did nothing to lower the height, above the rig floor, of the pipe connection being worked by that arrangement.

There is a need to suspend a spider in the rotary table opening without using structure that interferes with activity above the rig floor. An elevator can be suspended in the rotary table opening and function as a spider.

SUMMARY OF THE INVENTION

A shaped plate, or comparably shaped structure capable of a bridging function, is provided on each side of the spider to replace the bails and transfer the pipe string load from the spider ears, or lugs, to the rig floor. At present, it is not advantageous to weld up the plate from an assortment of structural elements because solid plate is more economical. If lugs are to be engaged by the plate, there are cutouts, or openings, to accept the lugs and a cross channel in the plate to accept attachment means, preferably a pin. If the spider has ears, the cut-outs accept the pin ends of clevis', or shackles, and the shackles swing through the opening below the ears much as did the loops on the bails. Like a clevis, the shackle has ends that are adjacent and provided with aligned holes, or eyes, for a closing pin. The eyes in the shackle receive the preferred horizontally extending pin in the cross channel. If solid plate is used, a simple cross bore can be drilled for the cross channel. It leaves a cleaner upper surface on the plate.

When pinned together, the two plates and the spider suspended below them form a composite package. The plates, collectively, have geometry that carries the pipe string load to the rig floor. A generally squared plan form is convenient and a structurally efficient shape for the paired plates. With the suspended spider in the opening of the rotary table the plates extend beyond the rotary table opening to bear upon the rig floor, or rotary table upper flange. The plates are shaped to leave a generally central opening to accept a vertical pipe string. With their thickness above the rig floor plane the preferred plate arrangement comprises a small, very stable, work platform.

The suspending structure can be the equivalent of a single composite structure if the supported spider is known to fit the attachment means. The paired plate arrangement is preferred because hinged spiders can be opened as much as is usually required of the spider while still attached to the suspending structure.

As a handling convenience, lifting eyes on the plates are situated over the cross channels, preferably cross bores, which are near the balance lines of the plates. Whether lifting just one plate or the assembly of plates and spider, parts lifted remain level and stable. This handling arrangement is not intended to lift a pipe string. This handling convenience is anticipated by the claims but is not to be construed in a limiting sense.

It is an object of this invention to provide bridging apparatus to suspend a spider in the opening of a rotary table to reduce the height of the upper end of a suspended pipe string when pipe sections are being added.

It is another object to provide apparatus to suspend a spider that has either lugs or ears for support in the rotary table opening; adding only shackles to change from a lug-type to an ear-type spider.

These and other objects, advantages, and features of this invention will be apparent to those skilled in the art from a consideration of this specification, including the attached claims and appended drawings.

For the purpose of this application, the top of the rotary table and the adjacent load-bearing floor will be defined as the rig floor.

For the purpose of this application, support lugs and pad eyes on elevators and spiders are the same.

DETAILED DESCRIPTION OF DRAWINGS

Figure 1:
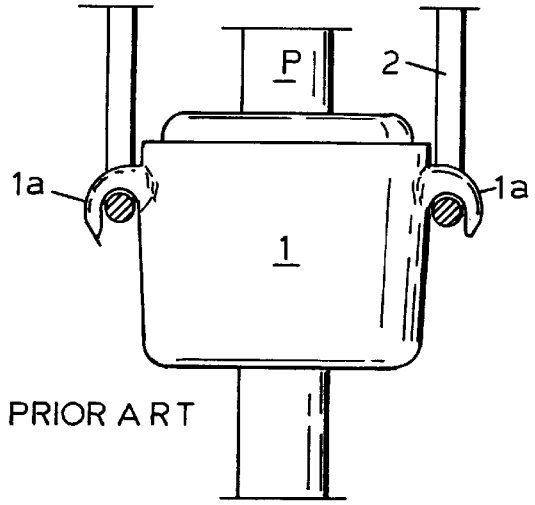
FIG. 1 is a side view of prior art use of the elevators to be used by apparatus of this invention.

In FIG. 1, prior art is shown with elevator 1 carried by traveling block bails 2 to support pipe string P. Ears 1*a* (collectively) have the ability to accept the rated pipe string load and have arcuate receptacles for the loops of the bails. Not shown, but usually present are closing links to prevent the bails from moving from engagement with the ears during brief unloaded intervals.

Both elevators and spiders, of this type, in known use have lifting attachment means on their housings that accept the rated pipe string loads and transfer those loads to the traveling block by way of bails or links. Such lifting attachment means in common use are ears or lugs.

Figure 2:
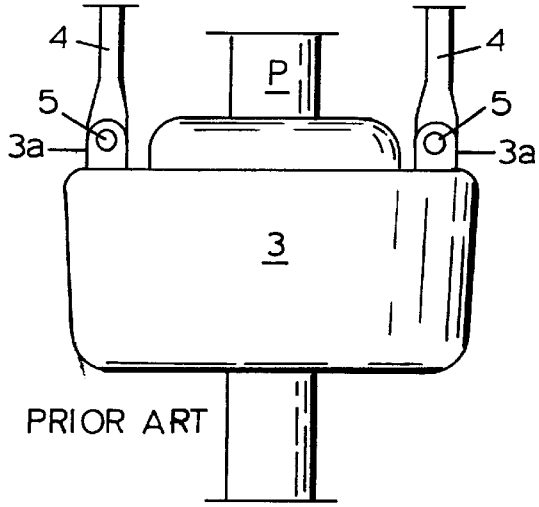
FIG. 2 is a side view of prior art use of an alternate form of spiders usable with apparatus of the invention.

FIG. 2 is the same arrangement as FIG. 1 but bails are replaced by links 4 which are secured to lugs 3*a* on elevator 3 by pins 5.

Figure 3:
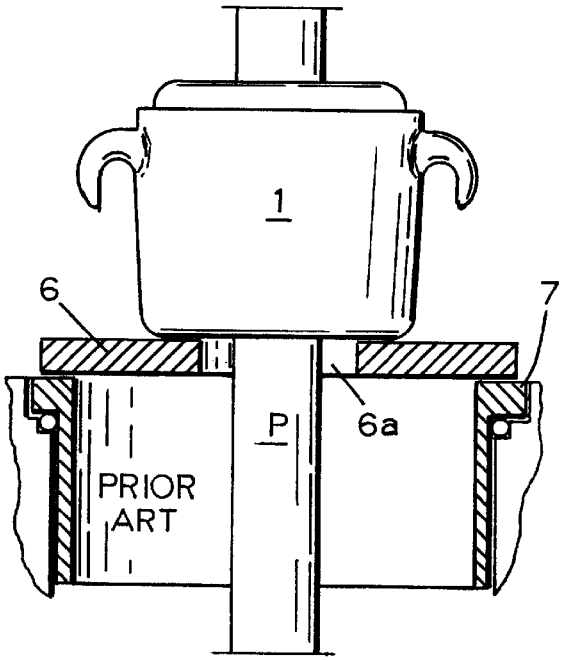
FIG. 3 is a side view of prior art adaptation of elevators for spider applications.

In FIG. 3 an arrangement in prior art utilizes a load-bearing plate 6 to support a spider above the rig floor. Plate 6 rests on the upper surface of the rotary table 7 and accepts pipe P through bore 6*a*.

Figure 4:
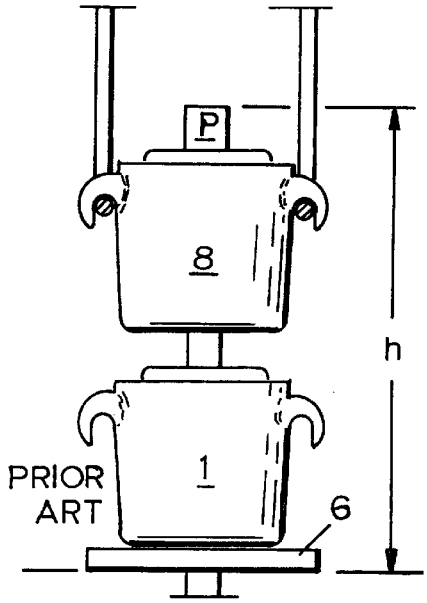
FIG. 4 is a side view of prior art use of elevators and spiders and illustrates the problem work height this invention solves.

FIG. 4 illustrates a prior art problem with the height of pipe string connectors above the rig floor when a spider and elevator are both above the rig floor. With the spider 1 on plate 6, and elevator 8 just above the spider, the connection to be worked is height h above the rig floor. When the elevator is removed from the pipe string and used to hoist another pipe section to be joined to the string, the pipe string cannot be lowered until the new connection is made. The connection working height h causes hazards that need to be avoided.

Figure 5:
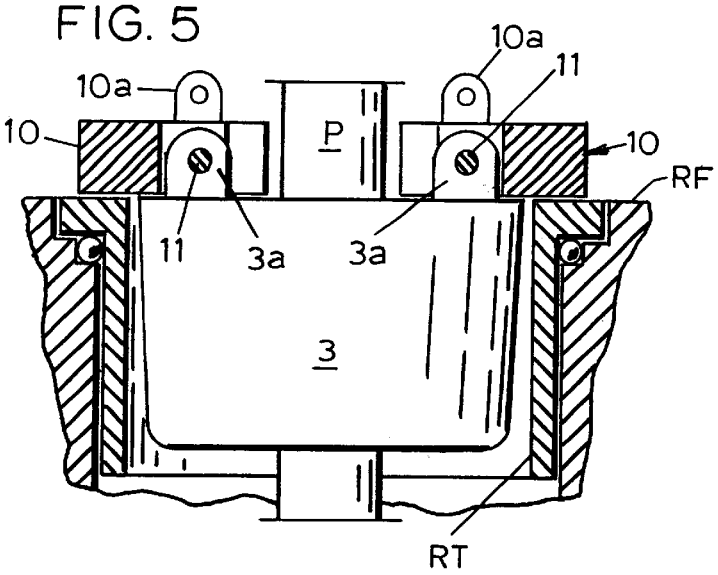
FIG. 5 is a sectional view taken along line 5—5 of FIG. 6.
Figure 7:
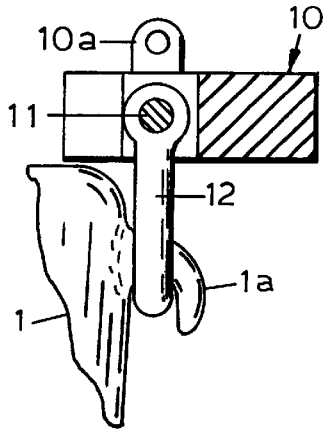
FIG. 7 is a sectional view taken along line 7—7 of FIG. 6.

FIG. 5 is a sectional view, taken along line 5—5, of the assembly of two identical plates 10, and spider 3. A converted elevator will now be referred to as a spider. The upper surface of rotary table RT and the adjacent floor RF will be referred to as the rig floor. The spider lugs 3*a* extend into openings 10*c* and are pinned there by pins 11, which extend along bore 10*b* to secure the plate to the spider 3. Attaching slings to the lifting pad eyes 10*a* can lift the assembly. The plates 10 are preferably shaped to balance about the center-line of bore 10*b*. The lifting eyes 10*a* are generally centered over the pin to stabilize the plate. The balance is beneficial when handling either individual plates or the assembly. FIG. 7 more clearly illustrates that feature.

Figure 6:
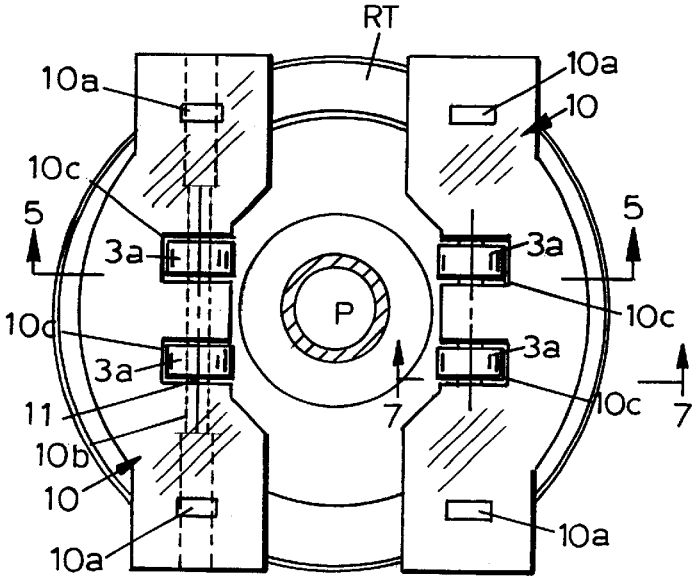
FIG. 6 is a top view of the assembly of FIG. 5.

FIG. 6 is a top view of the assembly of FIG. 5. Plates 10 extend beyond the rotary table RT and may bear upon the rig floor RF. Either surface, near the rotary table, can carry the load imposed by the spider but it normally rests upon the rotary table. Notches, or openings, 10*c* can accept lugs 3*a* or the shackle pin ends as shown in FIG. 7.

In FIG. 7 the plate is cut along line 7—7 but a shackle 12 is shown to support eared spiders.

Figure 8:
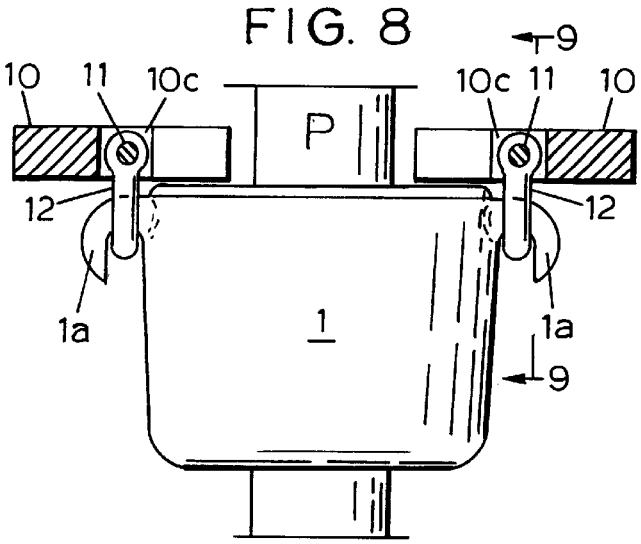
FIG. 8 is a sectional view similar to FIG. 5, without the rotary table, but using an alternate adaptation.

Comparing FIGS. 5 and 8 illustrates the dual-purpose function of the plates 10. By the use of the shackle 12, plate 10 can be used with eared spiders without modifying plates or spiders. Both forms of spiders, eared or equipped with lugs, are well distributed in the oil fields.

FIG. 8, without the rotary table, is similar to FIG. 5 with a spider having ears 1*a* rather than lugs 3*a*. Plates 10 are unchanged but shackles 12 are now required. Pin 11 remains unchanged.

Figure 9:
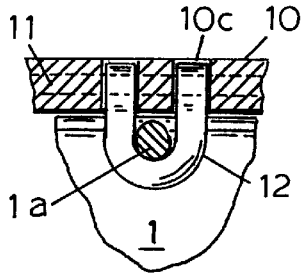
FIG. 9 is a sectional view, taken along line 9—9, of a selected part of the assembly of FIG. 8.
Figure 10:
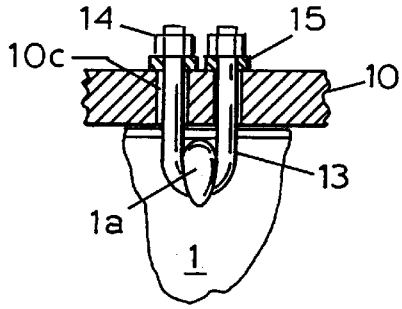
FIG. 10 is a view from the aspect of FIG. 9 with an alternate suspension element.

FIG. 9 presents a side view of the shackle and related load-bearing points. FIGS. 9 and 10 are fragmented views from the side of FIG. 8, showing two methods of suspending the ears from the plates. The shackle 12 serves the known eared spiders capable of fitting within the rotary table opening. The ears on other spiders may be differently spaced from the top of the housing. In case suitable shackles are not readily available, a qualified U-bolt 13 can be used. To use the U-bolt, pins 11 are not needed but washers 15 are used under nuts 14 to span the gap of the openings 10*c*.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

We claim:

1. A converter apparatus for resting on a rig floor, with arrangements to suspend a spider, having lifting attachment means, in the opening of a rotary table, the apparatus comprising:

a) a load distribution structure with means to bear on said rig floor, with means to accept pipe loads from the lifting attachment means of said spider and suspend said spider below said structure in the opening of said rotary table; and b) connection means adapted to connect said lifting attachment means on said spider and said means to accept pipe string loads on said load distribution structure.

2. The apparatus of claim 1 wherein said load distribution structure has a generally rectangular plan form.

3. A converter apparatus for resting on a rig floor and suspending a pipe string handling spider in the opening of the rotary table of a drilling rig, the spider housing having upwardly extending lugs for securing the traveling block lifting links, the apparatus comprising:

a) said pipe string handling spider with a plurality of said upwardly extending lugs;

b) a horizontally distributed suspension platform comprising two partial plates, each plate having openings to accept said upwardly extending lugs on said spider housing and a cross channel arranged to accept at least one laterally movable pin aligned to pass through the eyes of said lugs; and c) said movable pin, at least one in each said partial plate, sized to rest in said cross channel and penetrate said eyes.

4. The apparatus of claim 3 wherein said partial plates are identical with one partial plate rotated one-half turn in a horizontal plane relative to the other.

5. The apparatus of claim 3 wherein said partial plates are spaced apart such that said spider, if hinged, can be opened with said partial plates attached.

6.The apparatus of claim 3 wherein said horizontally distributed suspension platform has a generally rectangular plan form.

7. A converter apparatus for resting on a rig floor and suspending a pipe string handling spider in the opening of the rotary table, the spider having ears for engagement with bails for lifting, the apparatus comprising:

a) said pipe string handling spider with one said ear on each side;

b) a clevis shaped shackle, with aligned holes on the adjacent ends for a closing pin;

c) a horizontally distributed suspension platform comprising two partial plates, each plate having openings to accept said shackle and a cross channel arranged to accept a laterally extending pin aligned to penetrate said aligned holes; and d) said movable pin, at least one in each partial plate, sized to rest in said cross channel and extend through said aligned holes when said shackle is situated to suspend said spider by said ears.

8. The apparatus of claim 7 wherein said partial plates are identical with one partial plate rotated one-half turn in a horizontal plane relative to the other.

9. The apparatus of claim 7 wherein said partial plates are situated such that said spider, if hinged, can be opened with said partial plates attached.

10. The apparatus of claim 7 wherein each said removable pin and clevis-shaped shackle is replaced by a U-bolt with washer means to span said opening and a nut to crew on each end of said U-bolt.

11. The apparatus of claim 7 wherein said horizontally distributed suspension platform has a generally rectangular plan form.

12. A spider converter apparatus for resting on a rig floor and providing means to suspend either of two types of spiders, one type with load-bearing ears on the sides, each ear engaged by a shackle having adjacent ends with aligned holes extending, as load bearing elements, upwardly therefrom, and another type with lugs with aligned holes on each side of the spider, as load bearing elements, extending upwardly from the spider housing, the apparatus comprising:

a) a horizontally distributed base comprising two generally similar partial plates, each plate having openings to accept the load bearing elements extending from the spider being suspended, and a cross channel situated to carry a pin for alignment with said aligned holes in said lugs, said partial plates shaped such that when attached to said assembly they, collectively, provide an open center area for the passage of a vertically situated pipe string; and b) at least one cross pin situated in said cross channel in each said partial plate to engage said holes in said load bearing elements when they are in said openings.

13. The apparatus of claim 12 wherein said partial plates are identical with one partial plate rotated one-half turn in a horizontal plane relative to the other.

14. The apparatus of claim 12 wherein said partial plates are situated such that said spider, if hinged, can be opened with said partial plates attached.

15. The apparatus of claim 12 wherein each said clevis-shaped shackle is replaced by a U-bolt with washer means to span said opening and a nut to screw on each end of said U-bolt.

16. The apparatus of claim 12 wherein said horizontally distributed base has a generally rectangular plan form.

17. A converter apparatus for resting on a rig floor, with arrangements to suspend a spider, having lifting attachment means, in the opening of a rotary table, the apparatus comprising:

a) a load distribution structure with means to bear on said rig floor, with means to accept pipe loads from the lifting attachment means of said spider and suspend said spider below said structure in the opening of said rotary table; and b) connection means adapted to connect said lifting attachment means on said spider and said means to accept pipe string loads on said load distribution structure;

c) said load distribution structure comprising two generally similar partial structures, each attached to at least two said lifting attachment means on said spider.

18. The apparatus of claim 17 wherein each said partial structure is comprised of a single element of solid plate.

19. The apparatus of claim 18 wherein said means to accept pipe loads comprises at least one horizontally extending bore in said plate and at least one laterally extending pin in said bore arranged to extend through holes in said lifting attachment means.

20. A converter apparatus for resting on a rig floor, with arrangements to suspend a spider, having lifting attachment means, in the opening of a rotary table, the apparatus comprising:

a) a load distribution structure with means to bear on said rig floor, with means to accept pipe loads from the lifting attachment means of said spider and suspend said spider below said structure in the opening of said rotary table; and b) connection means adapted to connect said lifting attachment means on said spider and said means to accept pipe string loads on said load distribution structure;

c) said lifting attachment means including ears on said spider and a shackle to engage said means to accept pipe string loads.

* * * * *